US010677498B2

(12) United States Patent
Longsworth

(10) Patent No.: US 10,677,498 B2
(45) Date of Patent: Jun. 9, 2020

(54) BRAYTON CYCLE ENGINE WITH HIGH DISPLACEMENT RATE AND LOW VIBRATION

(75) Inventor: Ralph Longsworth, Allentown, PA (US)

(73) Assignee: SUMITOMO (SHI) CRYOGENICS OF AMERICA, INC., Allentown, PA (US)

( * ) Notice: Subject to any disclaimer, the term of this patent is extended or adjusted under 35 U.S.C. 154(b) by 836 days.

(21) Appl. No.: 14/406,982

(22) PCT Filed: Jul. 26, 2012

(86) PCT No.: PCT/US2012/048321

§ 371 (c)(1),
(2), (4) Date: Dec. 10, 2014

(87) PCT Pub. No.: WO2014/018041

PCT Pub. Date: Jan. 30, 2014

(65) Prior Publication Data

US 2015/0159586 A1 Jun. 11, 2015

(51) Int. Cl.
*F25B 9/06* (2006.01)
*F25B 9/14* (2006.01)
(Continued)

(52) U.S. Cl.
CPC ..... *F25B 9/06* (2013.01); *F02G 1/02* (2013.01); *F02G 3/02* (2013.01); *F04B 15/08* (2013.01); *F25B 9/14* (2013.01); *F02G 2250/03* (2013.01)

(58) Field of Classification Search
CPC ..... F04B 37/08; F04B 37/085; F02G 2270/00–95; F25B 2500/13; F25B 9/14
See application file for complete search history.

(56) References Cited

U.S. PATENT DOCUMENTS 1,462,655 A * 7/1923 Philip ..... F02F 3/12 92/212
2,607,322 A 8/1952 Collins
(Continued)

FOREIGN PATENT DOCUMENTS

CN 1892931 A 1/2007
CN 101109583 A 1/2008
(Continued)

OTHER PUBLICATIONS

British Office Action dated Apr. 4, 2016 for the Corresponding British Patent Application No. GB1501346.9.
(Continued)

*Primary Examiner* — Laert Dounis
(74) *Attorney, Agent, or Firm* — Katten Muchin Rosenman LLP

(57) ABSTRACT

To provide refrigeration below 200 K, a Brayton cycle engine contains a light reciprocating piston. The refrigerator includes a compressor, a gas-balanced reciprocating engine having a cold rotary valve, a counterflow heat exchanger, a gas storage volume with valves that can adjust system pressures, a variable speed engine and a control system that controls gas pressure, engine speed, and the speed of the piston. The engine is connected to a load such as a cryopanel, for pumping water vapor, through insulated transfer lines.

17 Claims, 2 Drawing Sheets

(51) Int. Cl.

| | |
|---|---|
| ***F04B 15/08*** | (2006.01) |
| ***F02G 3/02*** | (2006.01) |
| ***F02G 1/02*** | (2006.01) |

(56) References Cited

U.S. PATENT DOCUMENTS

| | | | | |
|---|---|---|---|---|
| 3,010,220 | A | 11/1961 | Schueller | |
| 3,045,436 | A | 7/1962 | Gifford et al. | |
| 3,119,237 | A | 1/1964 | Gifford | |
| 3,175,373 | A | 3/1965 | Holkeboer et al. | |
| 3,205,668 | A | 9/1965 | Gifford | |
| 3,338,063 | A | 8/1967 | Hogan et al. | |
| 3,613,385 | A | 10/1971 | Hogan et al. | |
| 3,620,029 | A | 11/1971 | Longsworth | |
| 3,768,273 | A | 10/1973 | Missimer | |
| 4,132,505 | A * | 1/1979 | Schuman | F02G 1/0435 417/207 |
| 4,150,549 | A | 4/1979 | Longsworth | |
| 4,372,128 | A | 2/1983 | Sarcia | |
| 4,484,458 | A | 11/1984 | Longsworth | |
| 4,543,794 | A | 10/1985 | Matsutani et al. | |
| 4,951,471 | A | 8/1990 | Sakitani et al. | |
| 4,987,743 | A | 1/1991 | Lobb | |
| 5,094,277 | A | 3/1992 | Grant | |
| 5,181,383 | A | 1/1993 | Goto et al. | |
| 5,193,348 | A | 3/1993 | Schnapper | |
| 5,361,588 | A | 11/1994 | Asami | |
| 5,386,708 | A | 2/1995 | Kishorenath et al. | |
| 5,387,252 | A | 2/1995 | Nagao | |
| 5,398,512 | A | 3/1995 | Inaguchi et al. | |
| 5,461,873 | A | 10/1995 | Longsworth | |
| 5,481,878 | A | 1/1996 | Shaowei | |
| 5,582,017 | A | 12/1996 | Noji et al. | |
| 5,590,533 | A | 1/1997 | Asami et al. | |
| 5,687,574 | A | 11/1997 | Longsworth et al. | |
| 6,038,866 | A | 3/2000 | Okamoto et al. | |
| 6,161,392 | A | 12/2000 | Jirnov et al. | |
| 6,205,791 | B1 * | 3/2001 | Smith, Jr. | F25B 9/10 60/520 |
| 6,256,997 | B1 | 7/2001 | Longsworth | |
| 6,347,522 | B1 | 2/2002 | Maguire et al. | |
| 6,374,617 | B1 | 4/2002 | Bonaquist et al. | |
| 6,415,611 | B1 | 7/2002 | Acharya et al. | |
| 6,438,994 | B1 | 8/2002 | Rashad et al. | |
| 6,530,237 | B2 | 3/2003 | Morse et al. | |
| 6,574,978 | B2 | 6/2003 | Flynn et al. | |
| 6,625,992 | B2 | 9/2003 | Maguire et al. | |
| 6,923,009 | B2 | 8/2005 | Kudaravalli | |
| 7,127,901 | B2 | 10/2006 | Dresens et al. | |
| 7,249,465 | B2 | 7/2007 | Arman et al. | |
| 8,448,461 | B2 | 5/2013 | Longsworth | |
| 8,776,534 | B2 | 7/2014 | Dunn et al. | |
| 8,783,045 | B2 | 7/2014 | Xu et al. | |
| 9,080,794 | B2 | 7/2015 | Longsworth | |
| 9,546,647 | B2 | 1/2017 | Longsworth | |
| 2003/0233826 | A1 * | 12/2003 | Luo | F01B 29/10 60/516 |
| 2005/0016187 | A1 | 1/2005 | Kudaravalli | |
| 2007/0119188 | A1 | 5/2007 | Xu et al. | |
| 2007/0214821 | A1 | 9/2007 | Astra | |
| 2007/0245749 | A1 | 10/2007 | Atkins et al. | |
| 2007/0253854 | A1 | 11/2007 | Dunn | |
| 2008/0092588 | A1 | 4/2008 | Xu et al. | |
| 2010/0016168 | A1 | 1/2010 | Atkins et al. | |
| 2010/0275616 | A1 | 11/2010 | Saji et al. | |
| 2011/0219810 | A1 | 9/2011 | Longsworth | |
| 2012/0017607 | A1 | 1/2012 | Bin-Nun et al. | |
| 2012/0085121 | A1 | 4/2012 | Longsworth | |
| 2012/0285181 | A1 | 11/2012 | Dunn et al. | |
| 2013/0008190 | A1 | 1/2013 | Longsworth | |
| 2013/0067952 | A1 | 3/2013 | Ri et al. | |
| 2013/0285663 | A1 | 10/2013 | Ri et al. | |
| 2014/0290278 | A1 | 10/2014 | Dunn et al. | |
| 2015/0226465 | A1 | 8/2015 | Longsworth | |
| 2015/0354865 | A1 | 12/2015 | Longsworth | |

FOREIGN PATENT DOCUMENTS

| | | | | |
|---|---|---|---|---|
| CN | 101469689 | A | 7/2009 | |
| CN | 102290187 | A | 12/2011 | |
| DE | 31 09 681 | A1 | 9/1982 | |
| DE | 3109681 | A1 * | 9/1982 | F02G 1/043 |
| DE | 101 90 484 | T1 | 6/2002 | |
| DE | 11 2005 003 132 | T5 | 2/2008 | |
| DE | 11 2011 100 912 | T5 | 1/2013 | |
| EP | 0101565 | A1 * | 2/1984 | F02G 1/0435 |
| EP | 0919722 | B1 | 7/2003 | |
| EP | 2211124 | A1 | 7/2010 | |
| EP | 2 562 489 | A1 | 2/2013 | |
| EP | 2562489 | A1 | 2/2013 | |
| JP | 57-58302 | | 4/1982 | |
| JP | 58-112305 | | 7/1983 | |
| JP | 63-259357 | A | 10/1988 | |
| JP | 1-269874 | A | 10/1989 | |
| JP | 3-237276 | | 10/1991 | |
| JP | 4-236069 | | 8/1992 | |
| JP | 05079717 | A | 3/1993 | |
| JP | 5-126426 | A | 5/1993 | |
| JP | 6-42405 | A | 2/1994 | |
| JP | H06-042405 | A | 2/1994 | |
| JP | 06-101917 | | 4/1994 | |
| JP | 08-222429 | A | 8/1996 | |
| JP | 08-279412 | | 10/1996 | |
| JP | 9-324958 | A | 12/1997 | |
| JP | 10-089789 | A | 4/1998 | |
| JP | 11-63697 | | 3/1999 | |
| JP | 11-063697 | A | 3/1999 | |
| JP | 11-248280 | | 9/1999 | |
| JP | 2000-506584 | A | 5/2000 | |
| JP | 2001355929 | A | 12/2001 | |
| JP | 2003-139427 | A | 5/2003 | |
| JP | 2003-523496 | A | 8/2003 | |
| JP | 2005-28132 | | 2/2005 | |
| JP | 2006-274939 | A | 10/2006 | |
| JP | 2006-275120 | A | 10/2006 | |
| JP | 2008-527308 | A | 7/2008 | |
| JP | 2008249201 | A | 10/2008 | |
| JP | 5095417 | B2 | 12/2012 | |
| JP | 2013-522576 | A | 6/2013 | |
| JP | 2014-513269 | A | 5/2014 | |
| SU | 1325195 | | 7/1987 | |
| WO | 97/33671 | | 9/1997 | |
| WO | 97/33671 | A1 | 9/1997 | |
| WO | 2006/075982 | A1 | 7/2006 | |
| WO | 2008/094357 | | 8/2008 | |
| WO | 2008/133965 | A1 | 11/2008 | |
| WO | 2011/115790 | A2 | 9/2011 | |
| WO | 2011/132231 | A1 | 10/2011 | |
| WO | 2012/154299 | A1 | 11/2012 | |
| WO | 2013/006299 | | 1/2013 | |
| WO | 2013/006299 | A1 | 1/2013 | |

OTHER PUBLICATIONS

Japanese Office Action dated Aug. 31, 2016 for the Corresponding Japanese Patent Application No. 2015-523063.

British Examination Report dated Aug. 5, 2016 for the Corresponding British Patent Application No. GB1501346.9.

Japanese Office Action dated May 30, 2017 for the Corresponding Japanese Patent Application No. 2015-523063.

Korean Office Action dated Jun. 12, 2017 for the Corresponding Korean Patent Application No. 10-2015-7004486.

International Search Report and Written Opinion dated Mar. 26, 2013, from the corresponding PCT/US2012/048321.

Japanese Office Action dated Dec. 15, 2015 for the Corresponding Japanese Patent Application No. 2015-523063.

Chinese Office Action dated Nov. 16, 2015 for the Corresponding Chinese Patent Application No. 201280074903.3.

Japanese Office Action dated Jul. 12, 2016 for the Corresponding Japanese Patent Application No. 2015-552664.

Chinese Office Action dated Jun. 17, 2016 for the Corresponding Chinese Patent Application No. 201480004578.2.

(56) References Cited

OTHER PUBLICATIONS

Korean Office Action dated Nov. 4, 2015 for the Corresponding Korean Patent Application No. 10-2015-7021208.
International Search Report and Written Opinion dated Apr. 18, 2014, from the corresponding PCT/US2014/010054.
German Office Action dated Aug. 1, 2017 for the Corresponding German Patent Application No. 11 2012 006 734.7.
International Search Report and the Written Opinion of the International Searching Authority dated Oct. 4, 2012, from corresponding International Application No. PCT/US2012/044104.
R. Khefer. Cryopumps-Refrigerators, Kriovakuumnaya tekhnika. Osnovy i primeneniya. Moskva, Energoatomizdat 1983, p. 144-145.
Korean Office Action dated Mar. 25, 2014 from corresponding Korean Application No. 10-2014-7001333, with English-language translation.
Extended European Search Report dated Mar. 26, 2015 for the Corresponding European Patent Application No. 12807347.5.
European Office Action dated Nov. 24, 2015 for the Corresponding European Patent Application No. 12807347.5.
Chinese Office Action dated Jan. 12, 2016 for the Corresponding Chinese Patent Application No. 201280043152.9.
European Office Action dated Apr. 1, 2016 for the Corresponding European Patent Application No. 12807347.5.
Chinese Office Action dated Dec. 3, 2014 for the Corresponding Chinese Patent Application No. 01280043152.9.
Specification and Drawings of U.S. Appl. No. 13/106,218.
C.B. Hood, et al. "Helium Refrigerators for Operation in the 10-30 K Range" Advances in Cryogenic Engineering, vol. 9, Plenum Press, New York (1964), pp. 496-506.
U.S. Office Action dated Sep. 28, 2017 from corresponding U.S. Appl. No. 14/693,486.
U.S. Office Action dated Jun. 29, 2016 from corresponding U.S. Appl. No. 14/655,853.
U.S. Office Action dated Dec. 9, 2016 from corresponding U.S. Appl. No. 14/655,853.
U.S. Notice of Allowance dated Jul. 26, 2017 from corresponding U.S. Appl. No. 14/655,853.
U.S. Office Action dated Oct. 10, 2014 from corresponding U.S. Appl. No. 13/489,635.
U.S. Office Action dated Jul. 2, 2015 from corresponding U.S. Appl. No. 13/489,635.
U.S. Office Action dated Dec. 17, 2015 from corresponding U.S. Appl. No. 13/489,635.
U.S. Office Action dated Jul. 15, 2016 from corresponding U.S. Appl. No. 13/489,635.
U.S. Notice of Allowance dated Sep. 22, 2016 from corresponding U.S. Appl. No. 13/489,635.
International Search Report and Written Opinion dated Feb. 17, 2012, from the corresponding PCT/US2011/054694.
File History of U.S. Appl. No. 13/039,763.
U.S. Office Action dated Sep. 20, 2012 from corresponding U.S. Appl. No. 13/252,244.
U.S. Notice of Allowance dated Feb. 1, 2013 from corresponding U.S. Appl. No. 13/252,244.
German Office Action dated Jul. 17, 2017 for the Corresponding German Patent Application No. 11 2014 000 403.0.
German Office Action dated Mar. 30, 2016 for the Corresponding German Patent Application No. 11 2014 000 403.0.
International Search Report and Written Opinion dated Aug. 24, 2016, from the corresponding PCT/US2016/035672.
U.S. Office Action dated Jan. 24, 2018 from corresponding U.S. Appl. No. 14/693,486.
Korean Office Action dated Jan. 31, 2018 for the Corresponding Korean Patent Application No. 10-2015-7004486.
British Examination Report dated Mar. 8, 2018 for the Related British Patent Application No. GB1510022.5.
Korean Office Action dated May 30, 2018 for the Corresponding Korean Patent Application No. 10-2015-7004486.
Japanese Office Action dated Jul. 17, 2018 for the Corresponding Japanese Patent Application No. 2015-523063.
Korean Office Action dated Aug. 21, 2018 for the Corresponding Korean Patent Application No. 10-2018-7018890.
U.S. Office Action dated Aug. 27, 2018 from corresponding U.S. Appl. No. 14/693,486.
British Examination Report dated Sep. 13, 2018 for the Corresponding British Patent Application No. GB1510022.5.
Japanese Office Action dated Sep. 25, 2018 for the Corresponding Japanese Patent Application No. 2017-552024.
German Office Action dated Jan. 17, 2019 for the Corresponding German Patent Application No. 11 2012 006 734.7
Japanese Office Action dated Dec. 4, 2018 for the Corresponding Japanese Patent Application No. 2015-523063.
Korean Office Action dated Jan. 4, 2019 for the Corresponding Korean Patent Application No. 10-2017-7036607.
U.S. Office Action dated Jun. 3, 2019 for the Related U.S. Appl. No. 15/563,055.
Chinese Office Action dated Sep. 9, 2019 for the Corresponding Chinese Patent Application No. 201680032147.6.
German Office Action dated Oct. 28, 2019 for the Corresponding German Patent Application No. 11 2016 002 485.1.
Korean Office Action dated Dec. 26, 2019, for the Corresponding Korean Patent Application No. 10-2015-7004486.

* cited by examiner

BRAYTON CYCLE ENGINE WITH HIGH DISPLACEMENT RATE AND LOW VIBRATION

BACKGROUND OF THE INVENTION

1. Field of the Invention This invention relates to a gas-balanced Brayton cycle engine and specifically to gas-balanced Brayton cycle engines designed to operate at about 150 K having input power in the range of 5 to 30 kW.

2. Background of the Invention

A Brayton-type or Brayton cycle engine includes three essential components: a gas compressor, a counter-flow heat exchanger, and an expander.

Four recent patent applications assigned to SHI Cryogenics describe gas-balanced Brayton cycle expansion engines and two adaptations, one to minimize cool down time to cryogenic temperatures, the other to cool a cryopump for pumping water vapor. A system that operates on the Brayton cycle to produce refrigeration consists of a compressor that supplies gas at a discharge pressure to a counterflow heat exchanger, which admits gas to an expansion space through a cold inlet valve, expands the gas adiabatically, exhausts the expanded gas (which is colder) through in outlet valve, circulates the cold gas through a load being cooled, then returns the gas through the counterflow heat exchanger to the compressor.

U.S. Patent Application Publication 2011/0219810 dated Sep. 15, 2011 by R. C. Longsworth describes a reciprocating expansion engine operating on a Brayton cycle in which the piston has a drive stem at the warm end that is driven by a mechanical drive, or gas pressure that alternates between high and low pressures, and the pressure at the warm end of the piston in the area around the drive stem is essentially the same as the pressure at the cold end of the piston while the piston is moving. U.S. Patent Application Publication 2012/0085121 dated Apr. 12, 2012 by R. C. Longsworth describes the control of a reciprocating expansion engine operating on a Brayton cycle, as described in the previous application, which enables it to minimize the time to cool a mass to cryogenic temperatures. U.S. Ser. No. 13/106,218 dated May 12, 2011 by S. Dunn, et al., describes alternate means of actuating the expander piston. U.S. Ser. No. 61/504,810 dated Jul. 6, 2011 by R. C. Longsworth describes the application of a Brayton cycle engine to cooling coils for cryopumping water vapor. The engines described in published patent application 2011/0219810 and U.S. Ser. No. 13/106,218 are referred to as "Gas-balanced Brayton cycle engines". A compressor system that can be used to supply gas to these engines is described in U.S. Patent Application Publication 2007/0253854 titled "Compressor With Oil Bypass" by S. Dunn filed on Apr. 28, 2006. The engine of this present invention incorporates a cold rotary valve which has some features in common with U.S. Pat. No. 3,205,668 dated Sep. 14, 1965 by W. E. Gifford, and U.S. Pat. No. 4,987,743 dated Jan. 29, 1991 by A. J. Lobb. It also incorporates a vibration absorbing double bumper as described in U.S. Pat. No. 6,256,997 dated Jul. 10, 2001 by R. C. Longsworth and an anti-abrasion coating on the piston as described in U.S. Pat. No. 5,590,533 dated Jan. 7, 1997 by H. Asami et al.

A cryopump for pumping water vapor requires a cryopanel that is cooled to a temperature between 120 K and 170 K. This is a lot warmer than the temperature range of 10 K to 20 K needed to cryopump air. A paper by C. B. Hood, et al., titled "Helium Refrigerators for Operation in the 10-30 K Range" in *Advances in Cryogenic Engineering, Vol.* 9, *Plenum Press, New York* (1964), pp 496-506, describes a large Brayton cycle refrigerator having a reciprocating expansion engine capable of producing more than 1.0 kW of refrigeration at 20 K. This refrigerator was developed to cryopump air in a large space chamber. Starting in the early 1970's cryopumping water vapor at temperatures in the range of 120 K to 170 K and capacities of 500 to 3,000 W have been dominated by refrigerators that use mixed gases as described in U.S. Pat. No. 3,768,273 dated Oct. 30, 1973 by Missimer. A more recent patent, U.S. Pat. No. 6,574,978 dated Jun. 10, 2003 by Flynn, et al., describes means of controlling the rate of cooling and heating a refrigerator of this type which produces about 500 to 3,000 W at about 150 K to pump water vapor The refrigerants used in mixed gas refrigerators include some that are being phased out because of their impact on global warming. It is thus desirable to use a Brayton cycle engine which uses helium, argon, or nitrogen, all environmentally friendly. The present invention is based on the recognition that a Brayton cycle engine that operates at about 150 K can be a lot simpler than one that is designed for lower temperatures. These simplifications make it practical to design an engine that can produce over 3,000 W of refrigeration and thus compete with present mixed gas refrigerators.

SUMMARY OF THE INVENTION

A particular feature of the invention is the design of a light weight reciprocating piston that provides a high displacement rate with low vibration. This is preferably accomplished by a reciprocating cup shaped piston having a bottom and a cylindrical side wall, the bottom separating a space near room temperature and an expansion space below 200 K, and the side wall sliding within a cylinder having a temperature gradient between room temperature and below 200 K. A drive stem is attached to the piston which can produce a reciprocating motion by pneumatic or mechanical forces. The engine that is described herein operates on a gas-balanced Brayton cycle as described in U.S. Ser. No. 13/106,218. Reciprocating motion is further minimized by using a cold rotary valve to cycle gas in and out of the cold expansion space.

BRIEF DESCRIPTION OF THE DRAWINGS

FIG. 1 shows the piston and valve position at the end of admitting high pressure gas.

FIG. 2 shows the piston and valve position at the end of venting gas to low pressure.

DESCRIPTION OF THE PREFERRED EMBODIMENT

Figure 1:
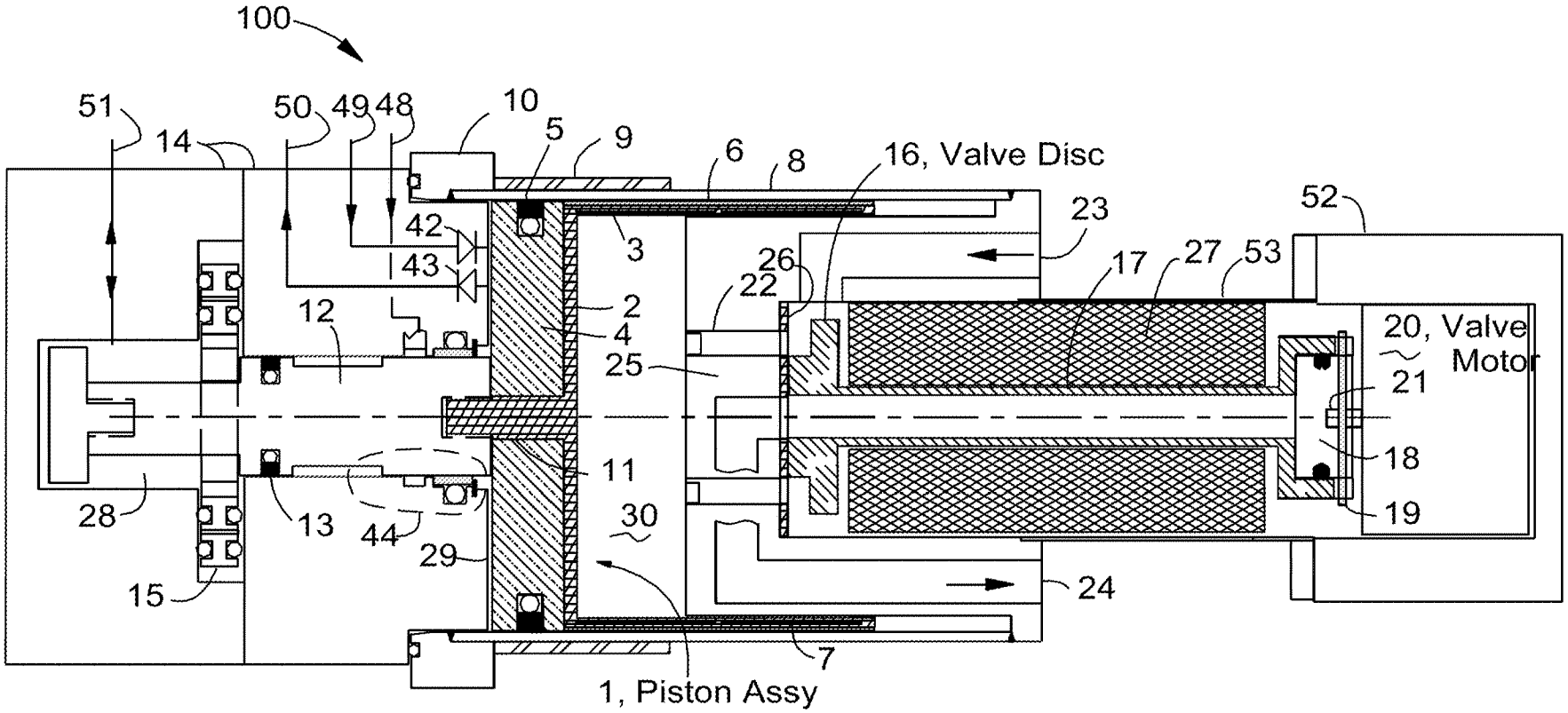
FIG. 1 is a cross-sectional view of an engine 100 which is comprised of a lightweight piston with a drive stem, a cylinder, a port to admit gas to the warm displaced volume, and a rotary cold valve to control the flow of gas in and out of the cold displaced volume.

FIG. 1 is a cross-sectional view of engine 100. Cup shaped piston 1 is comprised of the cup bottom 2, cylindrical sleeve 3, bottom cap 4, piston seal 5, anti friction coating 6, vacuum gap 7 within sleeve 3, piston coupling 11, and drive stem 12. Piston 1 reciprocates within cylinder 8 which is typically made of stainless steel because it has a low thermal conductivity. The piston cup bottom 2, and sleeve 3, which are contiguous, are also typically made of stainless steel in order to match the thermal expansion of the cylinder. Bottom cap 4 is made of a material like glass reinforced plastic that can nearly match the thermal expansion of stainless steel, has a relatively low thermal conductivity, and has a relatively low density. A bottom of the piston, comprising cup bottom 2 and bottom cap 4, comprises at least 80% nonmetallic material. In accordance with one embodiment of the present invention, a piston bottom cap 4 has a thickness of 24 mm, a piston cup bottom 2 thickness of 3 mm, and thus a piston bottom thickness of 27 mm a cylinder 8 ID of 140 mm and a piston length, (sleeve 3 plus cup bottom 2 plus bottom cap 4) of 100 mm.

The warm end of cylinder 8 is surrounded by cylinder sleeve 9 which has a high thermal conductivity in order to keep cylinder 8 near room temperature in the region where piston seal 5 reciprocates. Cylinder 8 is shown welded into warm flange 10 to which drive housing 14 is bolted.

Drive stem 28 has seal 13 that separates low pressure gas in 28 from the gas in displaced volume 29. Drive stem 12 engages double bumper 15 which has elastomer seals, for example, "O" rings that absorb the impact before piston 1 hits drive housing 14 or valve base 25. The gas porting at the warm end of engine 100 is shown for gas-balanced operation. Drive stem volume 28 is connected to low pressure through gas line 51. Gas lines 48, 49, and 50 are all connected to high pressure. FIG. 1 shows the piston and valve position at the end of admitting high pressure gas. While piston 1 has been moving towards the warm end with cold gas at high pressure flowing into cold displaced volume 30, gas at a slightly higher pressure has been flowing from warm displaced volume 29 through check valve 43 and out through line 50.

Figure 2:
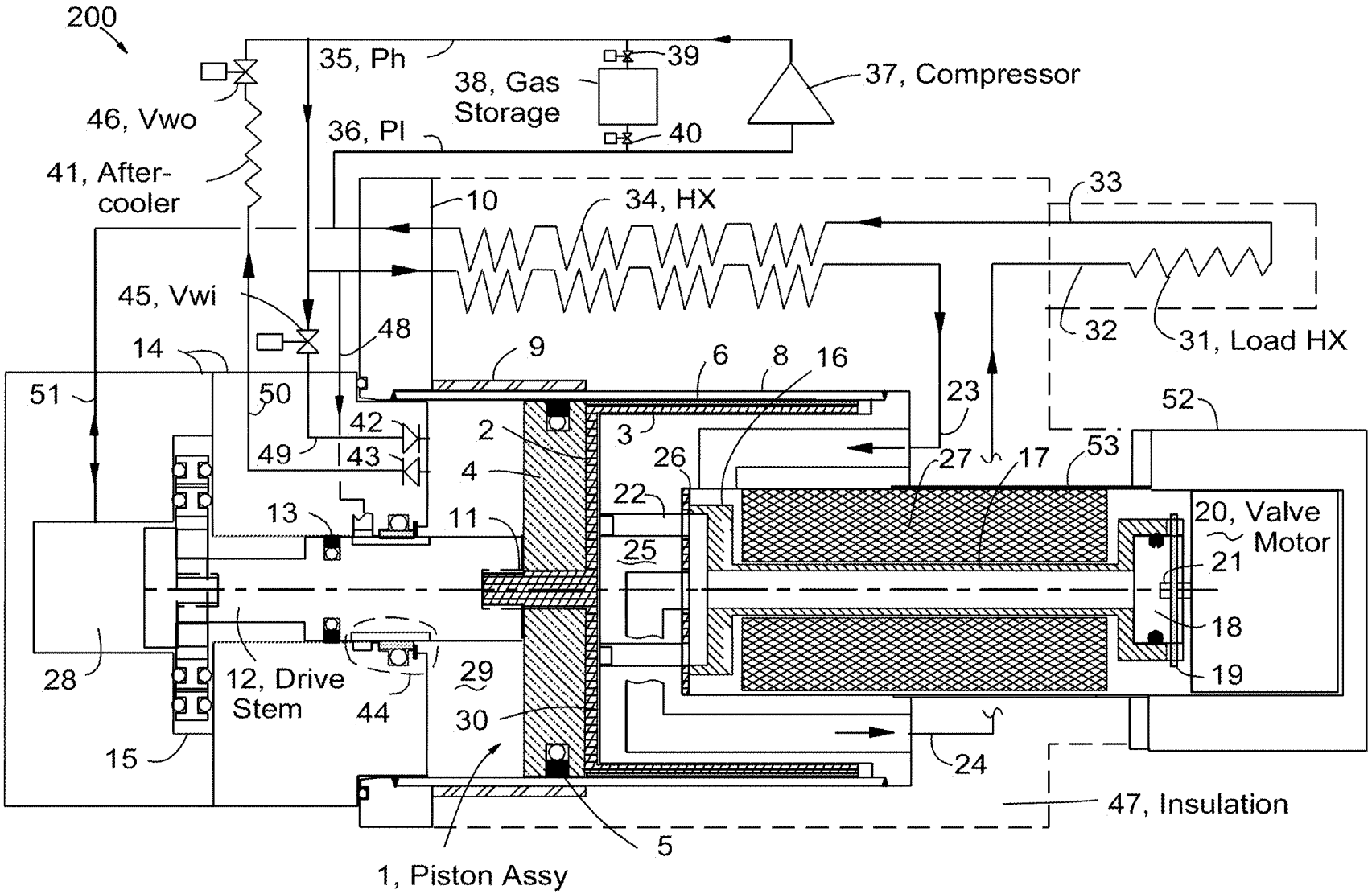
FIG. 2 is a schematic view of a refrigerator system 200 and the relation between engine 100 and the other components.

After piston 1 reaches the warm end rotary valve disc 16 turns to the position shown in FIG. 2 and starts venting gas in cold displaced volume 30 to low pressure. Gas flows into warm displaced volume 29 from high pressure line 49 through check valve 42. Valve 42 can be a pressure relief valve and there can be a restrictor in line 49 to control the speed at which piston 1 moves towards the cold end. It also keeps the pressure in 29 only slightly greater than in 30. When piston 1 reaches the cold end, as shown in FIG. 2, passive valve 44 opens and admits gas at high pressure from line 48 into warm displaced volume 29.

Rotary valve disc 16 has an extended shaft 17 that is coupled to valve motor shaft 21 by drive pin 19 through coupling 18. Valve motor 20 can operate at a fixed or variable speed. Valve disc 16 may be made of an aluminum alloy that has a low thermal conductivity and can be hard-coated. In the design shown it rotates on valve seat 26 which is a low friction polymer that is bonded to valve base 25. In FIG. 1 the valve is shown in the position where it admits gas at high pressure to cold displaced volume 30 through gas ports 23 and 22. In FIG. 2 valve disc 16 is shown rotated 90° to the position where gas flows from displaced volume 30 through ports 22 and 24 to low pressure. Valve motor housing 52, which is at room temperature, is separated from valve base 25 by sleeve 53. Sleeve 53 is made from a material having low thermal conductivity such as stainless steel. Heat losses between motor housing 52 and valve base 25 are further minimized by insulation 27.

FIG. 2 shows refrigerator system 200 and the relation between engine 100 and the other components. In addition to engine 100 system 200 includes compressor 37, gas storage tank 38, high pressure gas supply line 35, low pressure return line 36, counter flow heat exchanger 34, cold gas line at low pressure 32 to external load heat exchanger 31, and cold return line 33.

System pressures are controlled by valves 39, which puts excess gas from high pressure line 35 into storage tank 38, and valve 40, which puts gas from storage tank 38 into low pressure line 36.

The speed at which piston 1 moves is controlled by valves 45 and 46. Gas flows into displaced volume 29 at room temperature through valve 45 and flows out at an elevated temperature through after-cooler 41 and valve 46. Because operation is well above the temperature where air will liquefy it is practical to insulate the cold components with foam insulation, 47.

While the light weight piston which is the subject of this invention has been illustrated for a gas-balanced Brayton cycle engine it can be applied to other drive and control mechanisms. Several of these options are described in U.S. Patent Application Publication 2011/0219810 and U.S. Ser. No. 13/106,218.

Table 1 provides an example of the design and performance of engine 100 as shown in FIG. 1. The system uses helium at pressures of 2.2 MPa/0.8 MPa and draws about 26 kW of power. Performance is calculated for an average load temperature of 150 K.

TABLE 1

Example of the design and performance of engine 100 as shown in FIG. 1.

| | |
|---|---|
| Cylinder ID - mm | 140 |
| Piston length - mm | 100 |
| Piston bottom thickness - mm | 27 |
| Piston cap 4 thickness - mm | 24 |
| Piston sleeve thickness - mm | 4 |
| Stroke - mm | 36 |
| Speed - Hz | 5.5 |
| Piston weight - g | 2,000 |
| Refrigeration produced - W | 4,200 |
| Net refrigeration - W | 3,200 |

All patents, published patent applications, and pending applications mentioned in this application are hereby incorporated by reference in their entirety for all purposes.

What is claimed is:

1. A Brayton cycle engine for producing refrigeration at temperatures below 200 K, the engine comprising:

a reciprocating cup shaped piston having a piston bottom and a cylindrical side wall, wherein said piston bottom comprises a cup bottom and a bottom cap, said bottom cap includes a material having a low thermal conductivity, said piston bottom physically and thermally separates gas in a warm displaced volume near room temperature and gas in a cold displaced volume below 200 K, said side wall sliding within a cylinder having a temperature gradient between room temperature and below 200 K, the cup shaped piston having a piston seal between the piston bottom and the cylinder, and gas flow to said cold displaced volume controlled by one of cold inlet and outlet valves, and a cold rotary valve.

2. The Brayton cycle engine in accordance with claim 1, wherein a length of said piston is less than a diameter of the piston.

3. The Brayton cycle engine in accordance with claim 1, wherein a thickness of said piston bottom is less than 25% of a diameter of the piston.

4. The Brayton cycle engine in accordance with claim 1, further comprising a drive stem attached to the piston bottom that is a warm side of the piston, a pneumatic force or a mechanical force acting on the drive stem to cause said piston to reciprocate.

5. The Brayton cycle engine in accordance with claim 1, wherein gas is admitted to a cold end of said piston at high pressure and exhausted to low pressure through the cold rotary valve.

6. The Brayton cycle engine in accordance with claim 1, wherein said piston reciprocates at a variable speed.

7. The Brayton cycle engine in accordance with claim 1, wherein an interior of said cylindrical side wall is at least partially evacuated.

8. The Brayton cycle engine in accordance with claim 1, wherein the piston bottom comprises at least 80% nonmetallic material.

9. A gas-balanced Brayton cycle engine for producing refrigeration at temperatures below 200 K, the engine comprising:

a reciprocating cup shaped piston having a piston bottom and a cylindrical side wall, wherein said piston bottom comprises a cup bottom and a bottom cap, the cylindrical side wall is contiguous with the cup bottom, said bottom cap includes a material having a low thermal conductivity, said piston bottom physically and thermally separates gas in a warm displaced volume near room temperature and gas in a cold displaced volume below 200 K, said side wall sliding within a cylinder having a temperature gradient between room temperature and below 200 K, the cup shaped piston having a piston seal between the piston bottom and the cylinder, and gas flow to said cold displaced volume controlled by one of cold inlet and outlet valves, and a cold rotary valve; and a drive stem attached to a warm side of said piston.

10. The gas-balanced Brayton cycle engine in accordance with claim 9, wherein the cold inlet valve and the cold outlet valve admit high pressure gas when said piston is near cold end of said cylinder and exhaust gas to low pressure when said piston is near a warm end of said cylinder.

11. The gas-balanced Brayton cycle engine in accordance with claim 9, wherein the cold rotary valve admits high pressure gas when said piston is near cold end of said cylinder and exhausts gas to low pressure when said piston is near a warm end of said cylinder.

12. The gas-balanced Brayton cycle engine in accordance with claim 9, wherein said piston reciprocates at variable speed.

13. The gas-balanced Brayton cycle engine in accordance with claim 9, wherein a double bumper is actuated by said drive stem.

14. The Brayton cycle engine in accordance with claim 1, wherein the bottom cap and the cup bottom are made of different materials.

15. The Brayton cycle engine in accordance with claim 1, wherein the cup bottom is metallic.

16. The gas-balanced Brayton cycle engine in accordance with claim 9, wherein the bottom cap and the cup bottom are made of different materials.

17. The gas-balanced Brayton cycle engine in accordance with claim 9, wherein the cup bottom is metallic.

* * * * *